US007766150B2

(12) United States Patent
Guo et al.

(10) Patent No.: US 7,766,150 B2
(45) Date of Patent: Aug. 3, 2010

(54) PASSENGER CONVEYOR HANDRAIL WITH A UNIQUE SLIDING LAYER

(75) Inventors: Changsheng Guo, South Windsor, CT (US); John M. Milton-Benoit, West Suffield, CT (US); John P. Wesson, Vernon, CT (US); James R. Irish, Vernon, CT (US); Foster P. Lamm, South Windsor, CT (US)

(73) Assignee: Otis Elevator Company, Farmington, CT (US)

( * ) Notice: Subject to any disclaimer, the term of this patent is extended or adjusted under 35 U.S.C. 154(b) by 13 days.

(21) Appl. No.: 12/294,555

(22) PCT Filed: Apr. 24, 2006

(86) PCT No.: PCT/US2006/015448

§ 371 (c)(1),
(2), (4) Date: Sep. 25, 2008

(87) PCT Pub. No.: WO2007/123534

PCT Pub. Date: Nov. 1, 2007

(65) Prior Publication Data

US 2009/0127067 A1 May 21, 2009

(51) Int. Cl.
*B66B 23/24* (2006.01)

(52) U.S. Cl. ..... 198/335; 198/337

(58) Field of Classification Search ..... 198/335–337
See application file for complete search history.

(56) References Cited

U.S. PATENT DOCUMENTS

| | | | | |
|---|---|---|---|---|
| 3,633,725 | A | 1/1972 | Smith | |
| 3,981,118 | A | 9/1976 | Johnson et al. | |
| 4,488,631 | A * | 12/1984 | Courson | 198/335 |
| 4,776,446 | A * | 10/1988 | Fisher et al. | 198/337 |
| 5,033,607 | A * | 7/1991 | Rivera | 198/335 |
| 5,255,772 | A | 10/1993 | Ball et al. | |
| 5,736,225 | A | 4/1998 | Nagy | |
| 6,237,740 | B1 | 5/2001 | Weatherall et al. | |
| 2005/0011735 | A1 * | 1/2005 | Durrer et al. | 198/844.2 |
| 2005/0173224 | A1 * | 8/2005 | Caunce | 198/337 |
| 2006/0237284 | A1 * | 10/2006 | Miessbacher | 198/336 |
| 2008/0127974 | A1 * | 6/2008 | Lastow | 128/203.21 |

FOREIGN PATENT DOCUMENTS

| | | | | |
|---|---|---|---|---|
| DE | 3921877 | A1 * | 1/1991 | 198/337 |

OTHER PUBLICATIONS

International Search Report and Written Opinion of the International Searching Authority for International application No. PCT/US06/15448 mailed Nov. 1, 2006.

* cited by examiner

*Primary Examiner*—Mark A Deuble
(74) *Attorney, Agent, or Firm*—Carlson, Gaskey & Olds PC

(57) ABSTRACT

A passenger conveyor handrail (30) includes a sliding layer (40) that is non-woven in some examples and non-fabric in other examples. A first polymer material is used to establish a body portion (32) of the handrail (30) to provide, for example, a gripping surface (34). The sliding layer (40) is secured to a surface (38) of the handrail (30) to cover at least a portion of that surface to meet the needs of a particular situation. Disclosed examples include a variety of configurations and a variety of techniques for applying such a sliding layer (40) to a handrail (30).

23 Claims, 2 Drawing Sheets

PASSENGER CONVEYOR HANDRAIL WITH A UNIQUE SLIDING LAYER

FIELD OF THE INVENTION

This invention generally relates to passenger conveyors. More particularly, this invention relates to a sliding layer for use on a handrail of a passenger conveyor.

DESCRIPTION OF THE RELATED ART

Passenger conveyors such as escalators and moving walkways typically include moving steps or a moving belt for carrying passengers between landings at opposite ends of the conveyor. Handrails travel with the steps or belt to provide a surface for passengers to stabilize themselves while riding on a conveyor. Typical handrail construction includes a rubber or flexible thermoplastic body that provides the gripping surface for passengers. An underside of the body typically is coated with a sliding fabric such as cotton or polyester. The sliding fabric facilitates the handrail sliding along a guidance.

Ideally, a sliding fabric layer would have a surface characteristic that provides a low co-efficient of friction between the sliding layer and the guidance. Conventional handrail drive assemblies have limited the ability to utilize a low friction sliding layer on a handrail. Conventional handrail drive assemblies use friction and pinching rollers to engage both sides of a handrail to propel it in unison with the steps or moving belt so that the handrail moves along with passengers riding on the conveyor. The requirement for sufficient friction between the handrail drive mechanism and the handrail cannot be achieved if the sliding fabric layer is too slippery. The need for a low coefficient of friction while the sliding layer rides on the guidance and the need for a high coefficient of friction as the sliding layer is engaged by the drive mechanism has limited the choice of fabrics that are useful as a sliding fabric layer.

Another consideration in the choice of a sliding fabric is ensuring good bonding between the fabric and the material used to establish the body of the handrail.

One alternative proposal is shown in U.S. Pat. No. 3,633,725 where a fabric sliding layer is used on a "cover" for a handrail that is made of a thermoplastic material. That patent includes an arrangement where the thermoplastic material, itself, slides along a guidance. That arrangement is not typically found in existing handrails in use today.

Wear of a sliding fabric layer is a major contributor to the need to repair or replace passenger conveyor handrails. There is a need for an improved arrangement that reduces the amount of wear to provide extended handrail life and associated cost savings. This invention addresses those needs.

SUMMARY OF THE INVENTION

An exemplary passenger conveyor handrail includes a body portion comprising a first polymer material having a first thickness that establishes a gripping surface. A non-woven sliding layer having a second, substantially smaller thickness opposite the gripping surface comprises a second polymer material.

In one example, the non-woven slider layer is constructed as a sufficiently thin film to provide flexibility required to allow bending of the handrail.

In one example, the non-woven sliding layer is molded and secured to the body portion.

In one example, the non-woven sliding layer covers only selected portions of the surface of the body portion facing opposite the gripping surface.

In some examples, the non-woven sliding layer comprises one of a fluoropolymer-impregnated thermoplastic polyurethane, a polyoxymethylene material or nylon.

Another exemplary passenger handrail comprises a body portion having a first polymer material having a first thickness that establishes a gripping surface. A non-fabric sliding layer having a second, substantially smaller thickness is opposite the gripping surface and comprises a second polymer material.

In one example, the non-fabric sliding layer comprises a thin film.

An exemplary method of making a passenger conveyor handrail comprises establishing a gripping surface on one side of a body portion using a first polymer material. A sliding surface that is at least one of non-woven or non-fabric is provided on at least a portion of an opposite side of the body portion. The sliding surface comprises a second, different polymer material.

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

Figure 1:
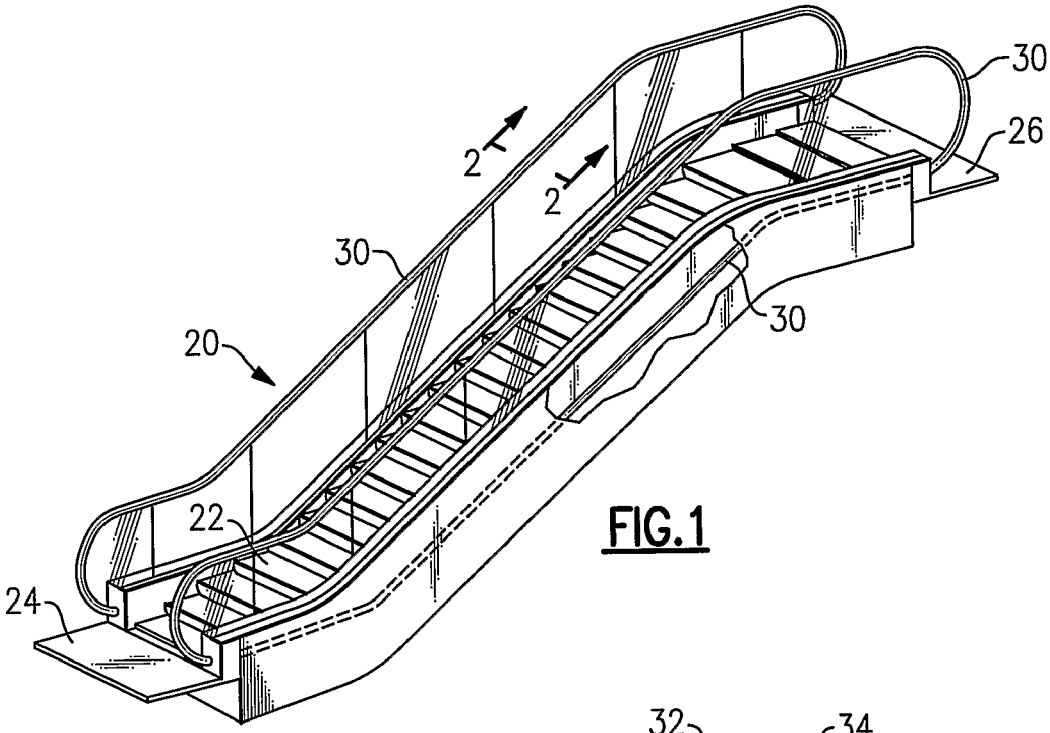
FIG. 1 diagrammatically illustrates an example passenger conveyor incorporating a handrail designed according to an embodiment of this invention.

FIG. 1 shows an example passenger conveyor 20. A plurality of steps 22 move between landings 24 and 26 to carry passengers in a desired direction. A handrail 30 follows a path along a guidance (not illustrated) to provide a surface for a passenger to hold onto as they ride the conveyor 20.

Figure 2:
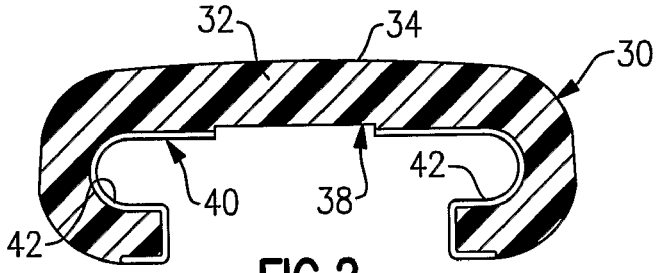
FIG. 2 is a cross-sectional illustration of an example handrail taken along the lines 2-2 in FIG. 1.

FIG. 2 shows one example handrail configuration where the handrail 30 includes a body 32 comprising a rubber or flexible thermoplastic material, for example. The body 32 establishes a gripping surface 34 that faces in a direction to be grasped by an individual riding on the conveyor 20, for example.

An oppositely facing surface 38 of the handrail body 32 has a sliding layer 40 secured in place. The sliding layer 40 is exposed to directly contact and slide along a conventional guidance (not illustrated) as the handrail moves in a known manner.

As can be appreciated from the illustration, the example sliding layer 40 is substantially thinner than the body 32 (e.g., the body 32 has a first thickness and the sliding layer 40 has a second, substantially smaller thickness). One example includes a thin film as the sliding layer 40. Using a thin sliding layer 40 allows the example handrail 30 to bend as needed. The first thickness in some examples is between twice and ten times as thick as the second thickness.

In the illustration of FIG. 2, a portion of the surface 38 is not covered by the sliding layer 40. In this example, the uncovered portion of the surface 38 provides a surface for a conventional handrail drive mechanism to engage the handrail 30 in a known manner. The uncovered material and the surface 38 that does not include a sliding layer 40 has sufficient friction characteristics to achieve the necessary traction with a conventional pinching roller style handrail drive.

The sliding layer 40 in one example comprises a fluoropolymer-impregnated thermoplastic urethane. In one example, the fluoropolymer comprises polytetrafluoroethylene (i.e., TEFLON®). In another example, the sliding layer 40 comprises a polyoxymethylene material. In still another example, the sliding layer 40 comprises nylon. Any one of these examples may also comprise a lubricant to further reduce a friction characteristic of the sliding layer 40.

A unique aspect of the example sliding layer 40 is that it is composed or constructed of at least one of a non-woven or a non-fabric sliding layer. Conventional arrangements relied upon a woven fabric layer such as cotton or polyester to establish a sliding layer. The disclosed example embodiments of this invention differ from the conventional approach in that the sliding layer 40 is not a fabric in some examples and is not woven in other examples. Unique sliding layer formations are used to provide enhanced handrail service life and better performance characteristics.

In one example, the sliding layer 40 is molded and secured onto the body portion 32 of the handrail 30 using an appropriate adhesive, given the polymer materials selected to establish the body portion 32 and the sliding layer 40. In one example, the sliding layer 40 is co-extruded at the time of forming the body portion 32. In such an example, a first polymer material is used to establish the body portion 32 and a second, different polymer material is used to establish the sliding layer 40.

In another example, the sliding layer 40 is overmolded onto a pre-formed body portion 32. Example overmolding techniques include placing the body portion 32 within a mold that is then used to form the sliding layer 40 and applying the sliding layer 40 material onto the desired portions of the surface 38 of the body portion 32. Example application techniques include brushing on, rolling on, spraying on or pouring on the material used to form the sliding layer 40.

As can be appreciated from FIG. 2, this example embodiment includes a sliding layer 40 over a substantial amount of the surface 38 of the handrail 30. A portion 42 of the sliding layer covers the so-called lip area of the surface 38. To facilitate the handrail bending around the turnarounds at each end of the conveyor travel, for example, the at least the portion 42 of the sliding layer 40 includes a plurality of slots 44 shown in FIG. 3 that are transverse to the direction of travel of the handrail during the passenger conveyor movement. In this example, the slots 44 facilitate a relatively harder material of the sliding layer 40 bending around the turnarounds as needed for a particular situation. The desire to provide a longer-lasting sliding layer 40 and desirable friction characteristics may require using relatively harder materials compared to those typically used to establish the body portion 32 or the gripping surface 34 of a handrail. The example of FIG. 3 includes the slots 44 to accommodate such materials and conventional handrail travel.

Figure 3:
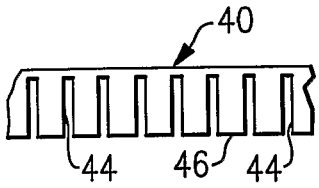
FIG. 3 schematically shows selected features of a portion of the embodiment of FIG. 2.

In this example, the slots 44 extend from an edge 46 of the sliding layer 40 at least along the portion 42 where the sliding layer 40 covers the lip area of the surface 38. Interrupting the sliding layer 40 with slots 44 as shown in FIG. 3 would not hinder the ability of the sliding layer 40 to provide a desired coefficient of friction for interaction between the handrail 30 and the guidance or other portion of the conveyor structure along which the handrail travels during normal operation because the exposed polymer of the surface 38 at the slots 44 will not contact a guidance. The sliding layer 40 in this example has a thickness that effectively separates the exposed surface 38 within the slots 44 from a guidance.

Figure 4:
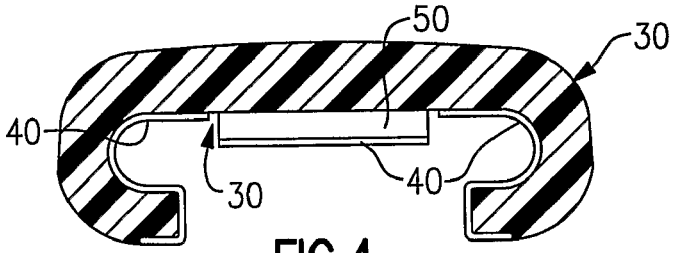
FIG. 4 is a cross-sectional illustration of another example embodiment from the same perspective as shown in FIG. 2.

FIG. 4 shows another example embodiment of a handrail 30 that includes a plurality of drive teeth 50 on the surface 38 of the handrail. The example teeth 50 are transverse to the direction of handrail movement. In this example, the sliding layer 40 extends along lateral portions of the surface 38 and is on the outermost edge of the teeth 50 to facilitate the teeth 50 sliding along an appropriately designed guidance. At the same time, the drive-engaging surfaces of the teeth 50 can be kept free of the material of the sliding layer 40 to have appropriate friction or traction characteristics associated with driving the handrail to propel it in the desired direction.

Figure 5:
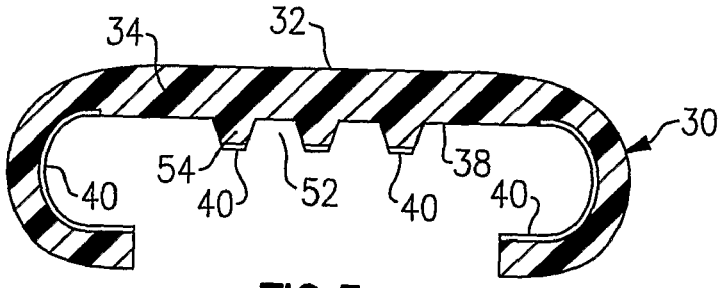
FIG. 5 is another example embodiment shown in cross-section from the same perspective as FIGS. 2 and 4.

FIG. 5 shows another example embodiment of a handrail 30 that includes longitudinally arranged grooves 52 and teeth 54. In this example, the outer edges of the teeth 54 are at least partially covered with the material of the sliding layer 40 to facilitate the teeth sliding along a guidance during handrail movement.

Figure 6:
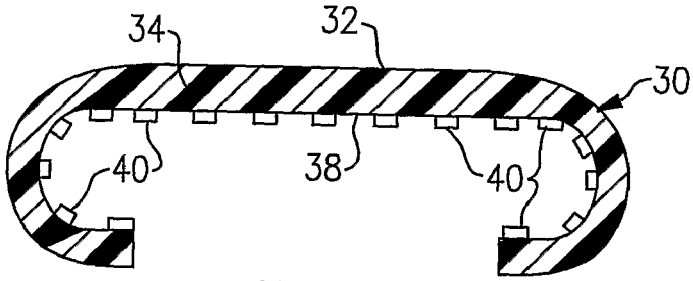
FIG. 6 is another example embodiment shown in cross-section.

FIG. 6 shows another example handrail 30 where the sliding layer 40 comprises a plurality of laterally spaced portions selectively positioned on the surface 38. In such an arrangement, the sliding layer 40 effectively elevates the surface 38 away from a guidance surface so that desired, low friction engagement between a guidance and the sliding layer 40 can be accomplished. One advantage to an arrangement as shown in FIG. 6 is that less sliding layer 40 material may be used while still achieving the benefits of an embodiment of this invention.

Figure 7:
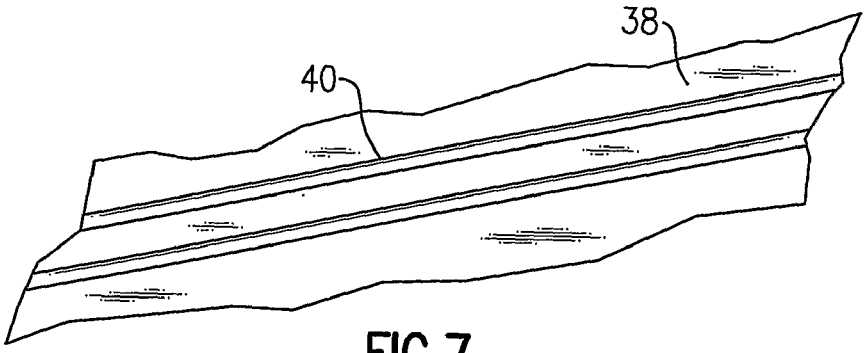
FIG. 7 schematically shows an example embodiment of a sliding layer.
Figure 8:
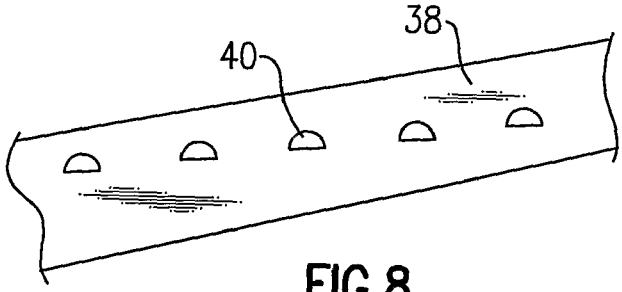
FIG. 8 is an illustration of another example embodiment of a sliding layer.

In one example, the sliding layer 40 comprises laterally spaced longitudinally extending strips of the material of the sliding layer 40. The strips in one example are molded. In another example, the strips comprise threads. This is shown in FIG. 7, for example. In another example shown in FIG. 8, a plurality of drops or beads of the material used to establish the sliding layer 40 are longitudinally spaced and laterally spaced in a desired pattern on the surface 38.

Some examples will include combinations of the different formations of the sliding layer 40 shown in the various illustrated examples. Given this description, those skilled in the art will realize what combination and what material selection will best meet the needs of their particular situation.

The disclosed examples have a variety of advantages compared to previous handrail designs. Using a low-friction material for the sliding 40 reduces the coefficient of friction as the handrail slides along a guidance. This provides extended handrail life. As the coefficient of friction is a dominant factor influencing a handrail's service life, reducing the coefficient of friction using an example embodiment of this invention extends that life and provides significant cost savings. Another advantage to the disclosed examples is they allow for reduced power consumption for moving the handrail. A lower coefficient of friction allows for using less power to move the handrail as desired. Another advantage is that there is less heat generation at the sliding surface, which provides better temperature control over the handrail and may allow for using less expensive materials in some instances.

Another advantage includes reducing the complexity of a handrail guidance arrangement. Many conventional systems include rollers associated with newels to reduce frictional force at the location of the newels. Adding such rollers increases the complexity and expense of the passenger conveyor assembly. Reducing a coefficient of friction using one of the example sliding layers 40 allows for eliminating such rollers without any adverse effects, which provides cost savings from a material and installation standpoint.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A passenger conveyor handrail, comprising:

a body portion that establishes a gripping surface, has a first thickness and comprises a first polymer material; and a non-woven sliding layer opposite the gripping surface, having a second, substantially smaller thickness and comprising a plurality of beads of a second, different polymer material, the sliding layer covering only selected portions of a side of the body portion facing opposite the gripping surface such that the material of the body portion on the side is exposed where the sliding layer is not present.

2. The handrail of claim 1, wherein the non-woven sliding layer is molded and secured to the body portion.

3. The handrail of claim 1, wherein the non-woven sliding layer comprises a thin film.

4. The handrail of claim 1, wherein the non-woven sliding layer comprises a plurality of longitudinally extending strips of the second polymer material.

5. The handrail of claim 1, wherein the non-woven sliding layer comprises two laterally spaced portions and the body portion has a central portion that has an exposed polymer material that is different than the second polymer material.

6. The handrail of claim 1, wherein the second polymer material comprises at least one of a flouropolymer impregnated urethane, polyoxymethylene or nylon.

7. The handrail of claim 1, wherein the second polymer material includes a lubricant.

8. The handrail of claim 1, wherein the sliding layer includes a plurality of slots arranged transverse to a direction of travel of the handrail.

9. A passenger conveyor handrail, comprising:

a body portion that establishes a gripping surface, has a first thickness and comprises a first polymer material; and a non-fabric sliding layer opposite the gripping surface, having a second, substantially smaller thickness and comprising a plurality of beads of a second, different polymer material, the non-fabric sliding layer covering only selected portions of a side of the body portion facing opposite the gripping surface such that the material of the body portion on the side is exposed where the sliding layer is not present.

10. The handrail of claim 9, wherein the non-fabric sliding layer is molded and secured to the body portion.

11. The handrail of claim 9, wherein the non-fabric sliding layer comprises a thin film.

12. The handrail of claim 9, wherein the non-fabric sliding layer comprises a plurality of longitudinally extending strips of the second polymer material.

13. The handrail of claim 9, wherein the non-fabric sliding layer comprises two laterally spaced portions and the body portion has a central portion that has an exposed polymer material that is different than the second polymer material.

14. The handrail of claim 9, wherein the second polymer material comprises at least one of a flouropolymer impregnated urethane, polyoxymethylene or nylon.

15. The handrail of claim 9, wherein the second polymer material includes a lubricant.

16. The handrail of claim 9, wherein the sliding layer comprises a plurality of slots arranged transverse to a direction of handrail movement.

17. A method of making a passenger conveyor handrail, comprising:

establishing a body portion having a first thickness using a first polymer material; and providing a sliding surface that is at least one of non-woven or non-fabric only on selected portions of a selected side of the body portion using a second, different polymer material having a second, substantially smaller thickness such that the material of the body portion on the selected side is exposed where the sliding surface is not present, the sliding surface comprising a plurality of beads of the second polymer material.

18. The method of claim 17, comprising molding the body portion; and over molding the sliding surface onto the selected side of the body portion.

19. The method of claim 18, comprising placing the molded body portion in a mold; and depositing the second polymer material into the mold to form the sliding surface.

20. The method of claim 17, comprising applying the second polymer material onto the selected side using at least one of pouring, dripping, brushing, rolling or spraying on the second polymer material.

21. The method of claim 17, comprising establishing a plurality of spaced sliding surface portions on the selected side.

22. The method of claim 17, comprising including a lubricant in the second polymer material.

23. The method of claim 17, wherein the second polymer material comprises at least one of a flouropolymer impregnated urethane, polyoxymethylene or nylon.

* * * * *